US005497959A

United States Patent [19]

Johnson et al.

[11] Patent Number: 5,497,959

[45] Date of Patent: Mar. 12, 1996

[54] CORELESS WINDING METHOD AND APPARATUS

[75] Inventors: Gary E. Johnson; Joseph A. Blume; Harlie C. Zahn, all of Green Bay, Wis.

[73] Assignee: Paper Converting Machine Company, Green Bay, Wis.

[21] Appl. No.: 139,545

[22] Filed: Oct. 20, 1993

Related U.S. Application Data

[63] Continuation-in-part of Ser. No. 36,702, Mar. 26, 1993, abandoned.

[51] Int. Cl.[6] ..... B65H 18/14; B65H 18/26; B65H 19/22

[52] U.S. Cl. ..... 242/542.2; 242/526; 242/533.3

[58] Field of Search ..... 242/542.2, 542, 242/533.7, 542.3, 533.3, 532.2, 526

[56] References Cited

U.S. PATENT DOCUMENTS

| | | | |
|---|---|---|---|
| Re. 28,353 | 9/1962 | Nystrand et al. | 242/541 |
| Re. 30,598 | 5/1981 | Spencer | 83/14 |
| 1,894,253 | 1/1933 | McCarthy | 242/542.3 |
| 2,775,410 | 12/1956 | Schwartz et al. | 242/541.2 |
| 2,870,340 | 1/1967 | Kwiteck | 164/68 |
| 3,856,226 | 12/1974 | Dowd, Jr. | 242/531.1 |
| 3,869,095 | 3/1975 | Diltz | 242/533.3 X |
| 4,133,495 | 1/1979 | Dowd | 242/542 X |
| 4,256,269 | 3/1981 | Feighery et al. | 242/542.2 X |
| 4,588,138 | 5/1986 | Spencer | 242/542.2 X |
| 4,667,890 | 5/1987 | Gietman, Jr. | 242/532.2 |
| 4,695,005 | 9/1987 | Geitman, Jr. | 242/527.7 |
| 4,807,825 | 2/1989 | Elsner et al. | 242/524 |
| 4,828,195 | 5/1989 | Hertel et al. | 242/542.2 X |
| 5,226,611 | 7/1993 | Butterworth et al. | 242/542.2 X |
| 5,257,898 | 11/1993 | Blume | 414/745.9 |

FOREIGN PATENT DOCUMENTS 1554619 5/1976 United Kingdom .

*Primary Examiner*—John Q. Nguyen

*Attorney, Agent, or Firm*—Tilton, Fallon, Lungmus & Chestnut

[57] ABSTRACT

A method and apparatus of coreless rewinding of retail-sized logs wherein the logs are developed alternately side-by-side on small diameter elongated mandrels.

1 Claim, 2 Drawing Sheets

CORELESS WINDING METHOD AND APPARATUS

This application is a continuation-in-part of our application Ser. No. 08/036,702 filed Mar. 26, 1993, abandoned.

BACKGROUND AND SUMMARY OF INVENTION

This invention relates to a coreless winding method and apparatus and, more particularly, to one that produces products without cores using small diameter mandrels on a continuous basis to develop retail size logs from jumbo parent rolls.

It is known that toilet tissue is being produced using cores with glue applied to the exterior. This is done with both center and surface rewinders—see, for example, co-owned U.S. Pat. RE. No. 28,353 and U.S. Pat. No. 4,828,195, respectively. Going back a long time, tissue products were produced on stop-start rewinders using small mandrels which were surface driven. Still another process is center winding without cores by using a mandrel that collapses after the completion of the wind cycle as seen in U.K. Patent No. 1,554,619 but which does not permit small diameter mandrels.

According to the invention, the winding is performed at alternating positions. This permits the use of small mandrels because each mandrel can be supported at multiple points along its length. Also, the finished wound roll can be decelerated and ejected from the machine while the opposing wind station is winding the next log.

The concept of alternate winding is old per se but not for finished size logs. For example, U.S. Pat. No. 1,894,253 winds the jumbo rolls alternately—but with a web being delivered from the paper making machine. More particularly, the web being wound into alternate jumbo rolls comes continuously from the last pass of the calendar stack of the paper making machine. This jumbo size roll has not been cut into retail roll lengths, as in the invention—but instead is taken to a converting area for rewinding into retail diameter logs which are then transversely severed by log saws. So there was no point in removing the winding reels from the jumbo log since these reels were needed to support the jumbo rolls in the rewinder. Other forms of surface winders can be seen in U.S. Pat. No. 4,256,269 and co-owned U.S. Pat. No. 4,588,138 but neither of these dispenses with a core, as in the instant invention.

Other objects and advantages of the invention may be seen in the details of construction and operation set forth in the ensuing specification.

BRIEF DESCRIPTION OF DRAWING

The invention is described in conjunction with the accompanying drawing in which—

DETAILED DESCRIPTION

Figure 1:
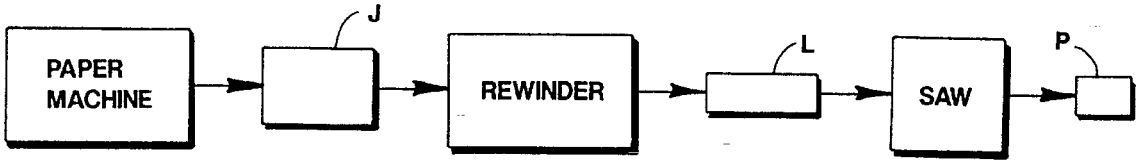
FIG. 1 is a schematic representation of the material flow starting with a paper machine and ending with the finished product.

In the illustration given in FIG. 1, a flow diagram is depicted which applies to the instant invention. At the extreme left the box marked PAPER MACHINE represents a paper making machine of conventional construction. Normally this machine will make use of a pulp slurry being introduced onto a Fourdrinier wire followed by drying rolls to bring the moisture content to about 5%.

This results in a web that can be wound into a jumbo size roll J seen schematically to the right of the paper machine in FIG. 1. Depending upon the paper machine and the requirements of the converter, the jumbo roll J may vary in diameter from 5 to 10 feet and in length from 4 to 20 feet. Currently, the trend is toward wider machines to achieve greater production at the same rate of web speed.

After the jumbo roll has been wound, it is transported usually to a converting area or section where a number of rewinders are located. The instant invention makes use of a surface rewinder such as that indicated previously to be found in co-owned U.S. Pat. No. 4,828,195. With ever increasing rates of speed of paper machines, it is sometimes necessary to use two or more rewinders to convert the output of a particular paper making machine.

In any event, the output of the rewinder is in the form of a log having a length equal to the width of the web in the jumbo roll J. The difference is in the diameter because the log L has a diameter corresponding to that of the retail size roll of bathroom tissue, kitchen toweling, etc. This may range variously from 4 to 10" (100–250 mm.).

Figure 2:
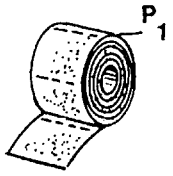
FIGS. 2 and 3 are perspective views of the finished product of FIG. 1—being respectively a roll of bathroom tissue and a roll of kitchen toweling.
Figure 3:
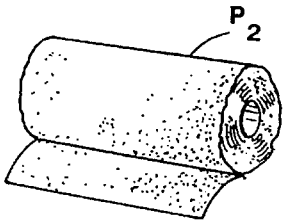

Thereafter, the log is processed through a log saw such as that seen in co-owned U.S. Pat. RE. No. 30,598. This results in a plurality of products from P from each log L. Most generally, the products may take the form of a roll of bathroom tissue $P_1$ as seen in FIG. 2 or a roll of kitchen toweling $P_2$ as seen in FIG. 3. These lengths are generally less than about 15" (375 mm.).

Figure 4:
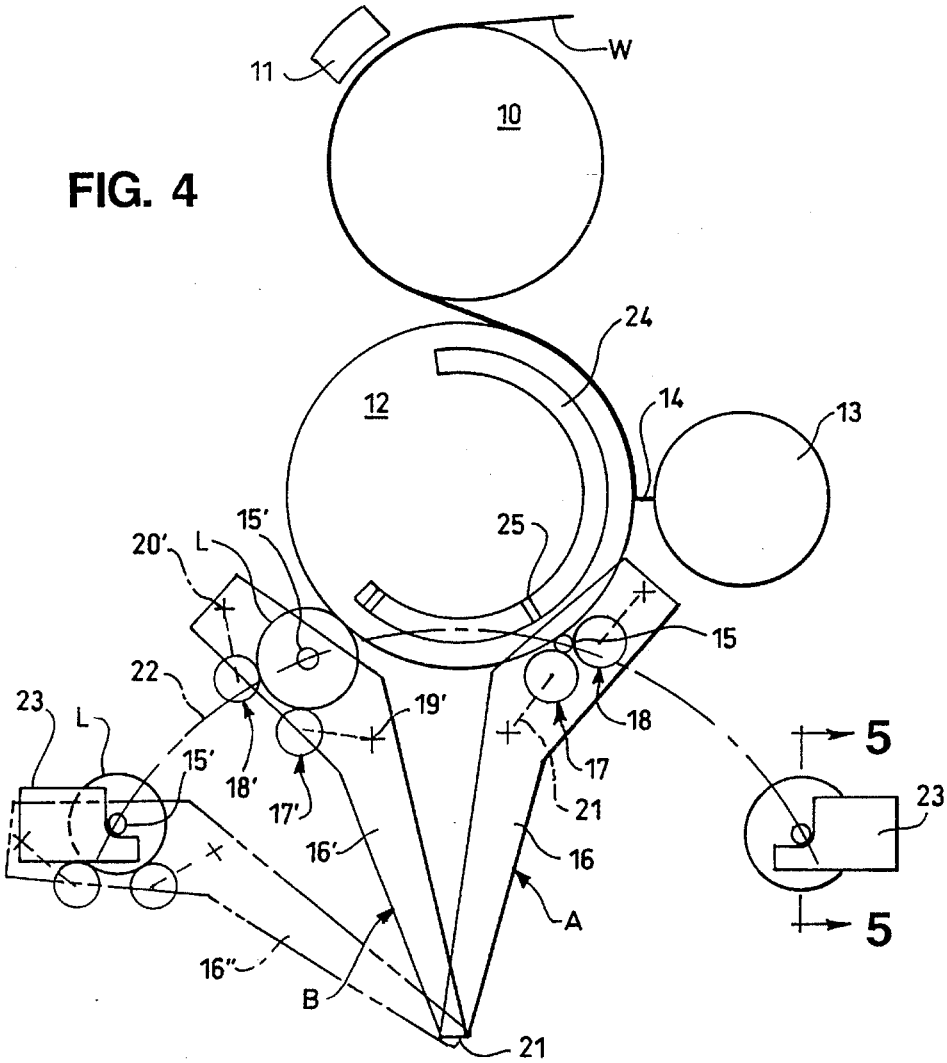
FIG. 4 is a side elevational view (essentially schematic) of a rewinder utilizing the teachings of this invention.
Figure 6:
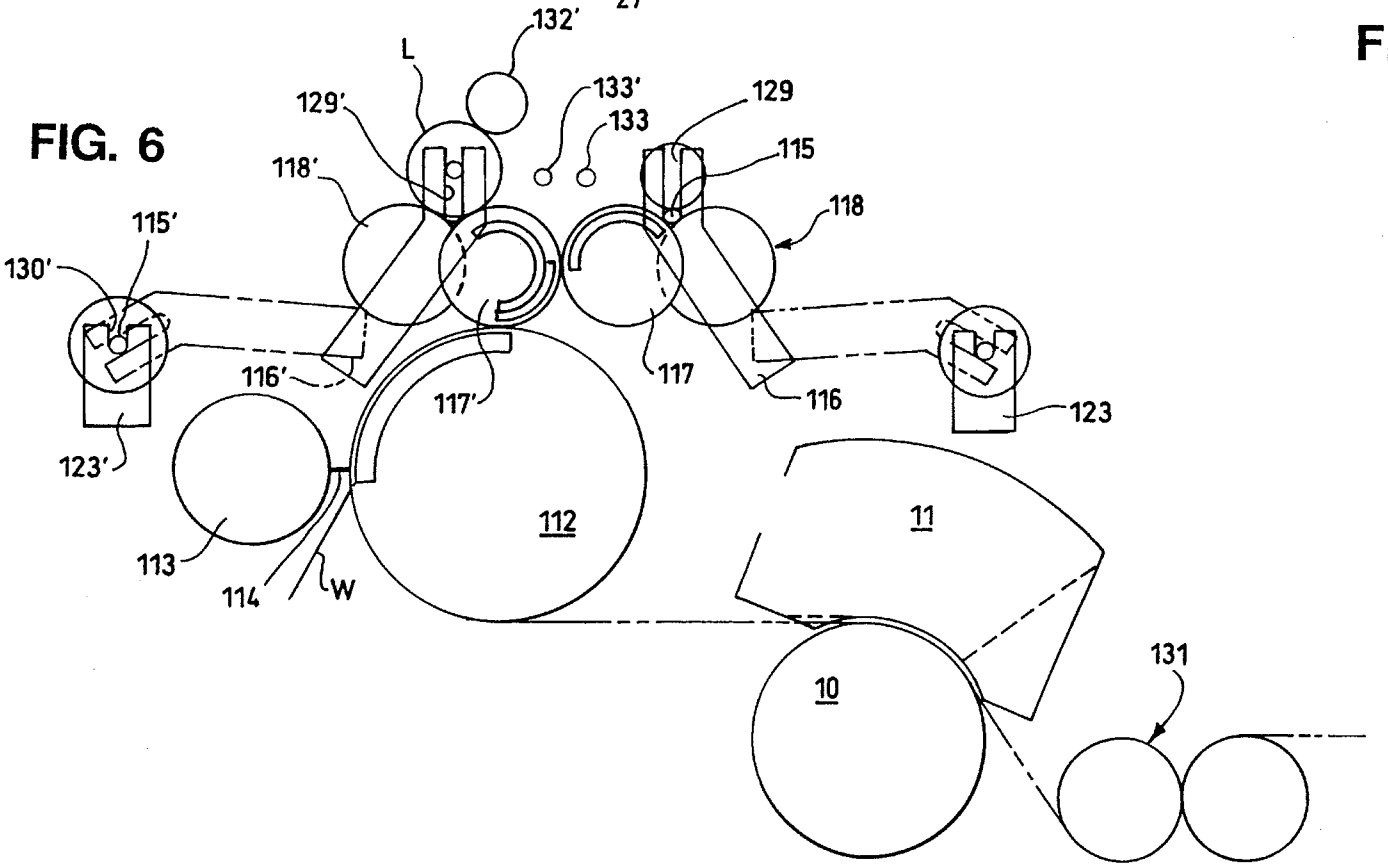
FIG. 6 is a view similar to FIG. 4 but of a modified embodiment of the invention.

With this background, we now proceed to describe the method of winding of the instant invention, as seen in embodiments of FIGS. 4 and 6.

In each of the embodiments of FIGS. 4 and 6, the machine has conventional draw rolls and perforator, the draw rolls being seen in U.S. Pat. RE. No. 28,353 and the perforator in co-owned U.S. Pat. No. 2,870,840.

FIG. 4 Embodiment

Referring now to FIG. 4, the symbol W at the extreme top of the view designates a web coming from pull rolls (not shown) and traveling in partial wrapping engagement with a perforator roll 10. The numeral 11 designates the stationary knife bar cooperating with the perforating bedroll 10 as seen in the above-identified U.S. Pat. No. 2,870,840. This results in transverse lines of perforation which, in the U.S., are spaced 4-½" for toilet tissue and 11" for kitchen toweling.

The web W after having been transversely perforated on the center distances indicated above travels to and in partial wrapping engagement with the principal bedroll 12, i.e., the "transfer" bedroll. The bedroll 12 operates in conjunction with a chopper roll 13 and has several functions. The bedroll is used to determine sheet count in a wound log. Usually, the bedroll is engineered for 10 sheets per revolution. When a bedroll attains the correct number of revolutions, a blade mechanism in the bedroll meshes with the blade 14 and the chopper roll 13 to sever the web W and yield the desired count, viz., 350, 500, etc. sheets each 4-½" square, 11" etc. The sheets are defined as lying between adjacent lines of transverse perforation.

The blade engagement is along a line of transverse perforation so as to yield the exact count and sheets ahead of the blade, i.e., downstream, are wound onto a roll or log that is completing its winding cycle as at L in the left center of FIG. 4. The portion of the web trailing the engaging blades is carried to a mandrel 15 in the position A in FIG. 4—see the right hand side of the view. The log L in the process of being completed is in the position B which is to the left in FIG. 4.

FIG. 4 Winding Operation—Generally

As the log L is being wound, axially spaced arms 16' which rotatably support winding drums 17', 18' move away from bedroll 12 to allow for the increase of the wound log diameter —compare the angular positions of the arm 16' to the left with the arm 16 to the right, i.e., in position A.

Even further, the winding drums 17', 18' are pivotally mounted at 19' and 20' so as to move during the course of the wind and also accommodate the increase in roll diameter—again compare the positions of the winding drum 17', 18' with the positions of the winding drums 17, 18 in position A and the change in angularity of the pivot arms—the arm supporting winding drum 17 being designated 21.

Provided but omitted for ease of presentation and understanding are drive means for the winding drums 17, 18 and 17', 18' which can include prime mover means on each of the arms 16, 16' such as an electric motor and belt and pulley systems along with suitable clutches for controlling the duration of the wind cycle and stopping of the winding upon finishing of the winding cycle.

When the winding cycle is completed, the activity depicted at the lower left of FIG. 4 occurs. The arm 16' pivots counterclockwise about a pivot 21 so as to position the log L in a stripping position wherein the arm 16' now has the orientation designated 16". This is achieved by virtue of rotating the arm 16' and thus the mandrel 15' through the arc 22. This brings the mandrel 15' into a position in which the wound roll or log L is stripped off the mandrel 15' by means 23 and which can be seen in greater detail in FIG. 5.

For stripping of the log L, a portion of the support arm 16 or 16' (the latter in the 16" position) pivots to allow the finished log to be ejected from the wind mandrel. The portion of the arm 16, 16' which pivots to allow clearance for ejecting the log will return to its closed position after the log has cleared the mandrel end. Thereafter the arm 16 or 16' will return to lie in close proximity to the bedroll to receive the start of the next log.

Figure 5:
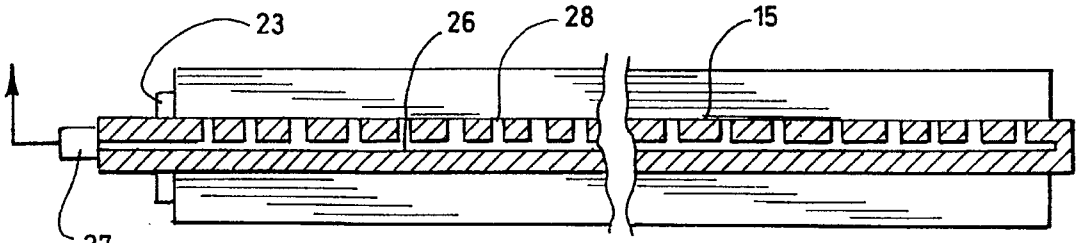
FIG. 5 is fragmentary end elevational view of a single mandrel such as would be seen along the sight line 5—5 applied to FIG. 4.

This is started by virtue of a leading edge being created by the knife 14 on the chopper roll 13 and the leading edge is conducted by the bedroll having the edge adhered thereto by vacuum applied to ports in the surface of the bedroll and which are connected to the vacuum ring 24. As the leading edge comes into a position of alignment with the mandrel 15, there is a pressure assist applied as at 25 to move the leading edge of the web away from the periphery of the bedroll 12 and into contact with the mandrel 15. The mandrel 15 is seen in FIG. 5 and there is relatively elongated having an axially extending passage 26 communicating with a source of vacuum 27 which in turn is connected to a vacuum pump (not shown). The vacuum applied through the axially extending passage 26 and the ports 28 result in the leading edge being adhered or pressed against the outer surface of the mandrel 15 so that the rotational effect of the rolls 17, 18 can cause the mandrel 15 to rotate and thus start to develop the log L.

Embodiment of FIG. 6

Again, the rewinder makes use of standard draw rolls and a perforator such as is seen in the embodiment of FIG. 4. In FIG. 6, the web W is seen to travel in partial wrapping engagement with the bedroll 112 which functions in conjunction with a chopper roll 113 having a knife 114 to create the end of one log and start the beginning of another. The bedroll 112 is used to determine the number of sheets in a wound log. Again, the bedroll 112 is usually engineered for ten sheets per revolution. When the bedroll 112 attains the correct number of revolutions, a blade mechanism in the bedroll 113 cooperates with the blade 114 and the chopper roll 113 to sever the web.

The portion of the web ahead of the blade is wound into a log L in the left hand position. The portion of the sheet trailing the blade 114 is picked up by a vacuumized drive roll 117 and transferred to a second vacuumized drive roll means 118. This carries the leading edge of the web to the mandrel 115 to start the next winding cycle.

The winding cycle is achieved by the vacuumized roll means 117, 118 which are radially slotted and intermeshed as can be appreciated from the showing in the FIG. 6—thus creating a cradle or nip where their peripheries intersect. These can be considered "ring" rolls because of the axial interruption and interlacing.

After the wind cycle is completed, these ring rolls 117, 118 are decelerated to stop the wound log and to prepare for ejecting the log. This is illustrated at the extreme right and left hand positions in FIG. 6 and here it will be noted that the arms 116, 116' are slotted as at 129 and 129' for the two arms. The arms are pivotally mounted on the frame to move from an essentially 12 o'clock position to a 3 or 9 o'clock position where the mandrel carried in the slot is engaged with a corresponding slot 130, 130' in the respective stripping means 123 and 123'.

More particularly, upon completion of the wind cycle, the arms 116, 116' for the right and left hand positions rotate to the log ejection station 123, 123'. Again, a portion of the support arm 116 or 116' pivots to allow the finished log to be ejected from the wind mandrel 115 or 115'. Thereafter the portion of the arm 116, 116' that pivots to allow clearance for ejecting the log will return to its closed position after the log has cleared the mandrel end. Thereafter, the arms return the mandrel 115, 115', as the case may be, to the wind position In this embodiment, the mandrel is slidably mounted in the slot 129 or 129' as the case may be and thus can move essentially radially outwardly relative to the bedroll 112 to accommodate the build-up of convolutely wound layers.

Also seen in the embodiment of FIG. 6 are draw rolls 131 which are upstream of the perforator 10, 11.

Inasmuch as the embodiment of FIG. 6 does not have the bedroll 112 contacting the log L during the winding cycle, I provide rider rolls 132 and 132' which are pivotally mounted on the machine frame as at 133 and 133'. For example, the rider roll 132 cooperates with the rolls 117 and 118 to provide a three-roll cradle for the surface winding. In like fashion, the rider roll 132' cooperates with the winding rolls 117' and 118'.

In the practice of the invention with each of the embodiments, it is advantageous to provide a mandrel having a diameter less than about 1" (25 mm.) and although many of these mandrels are quite elongated—upwards of ten feet (3 meters), the support provided by the winding roll means insures that undue deflection will not occur.

While in the foregoing specification a detailed description of the invention has been set down for the purpose of illustration, many variations in the details hereingiven may be made by those skilled in the art without departing from the spirit and scope of the invention.

We claim:

1. A method of coreless rewinding logs from a parent roll comprising the steps of providing first and second elongated winding mandrels and alternately winding a web directly on one of said mandrels to develop a predetermined diameter log while stripping a previously wound log from the other mandrel, said winding step including providing first arm means associated with said first mandrel and second arm means associated with said second mandrel, each arm means being arranged for carrying its said associated mandrel and supporting its said associated mandrel substantially along the mandrel length while rotating each mandrel by contacting the same with a surface drive, said stripping step including moving said first mandrel arm means from a winding position to a stripping position and then back to said winding position while said web is being wound on said second mandrel and transversely severing said log into a plurality of retail-sized products said step of providing arm means for carrying each mandrel including providing first and second pivotable arms, and a pair of driven rolls rotatably mounted on each of said pivotable arms and forming a cradle therebetween for rotatably supporting one of said mandrels.

* * * * *